US006484356B2

(12) United States Patent
Wörwag

(10) Patent No.: US 6,484,356 B2
(45) Date of Patent: Nov. 26, 2002

(54) VACUUM CLEANING TOOL WITH PEAR-SHAPED TURBINE CHAMBER

(75) Inventor: Peter Wörwag, Staad (CH)

(73) Assignee: Düpro AG, Romanshorn (CH)

( * ) Notice: Subject to any disclaimer, the term of this patent is extended or adjusted under 35 U.S.C. 154(b) by 0 days.

(21) Appl. No.: 09/943,498

(22) Filed: Aug. 30, 2001

(65) Prior Publication Data

US 2002/0042966 A1 Apr. 18, 2002

(30) Foreign Application Priority Data

Aug. 31, 2000 (DE) ..... 10042671

(51) Int. Cl.[7] ..... A47L 9/04
(52) U.S. Cl. ..... 15/387
(58) Field of Search ..... 15/387, 377

(56) References Cited

U.S. PATENT DOCUMENTS 2,812,155 A 11/1957 Woodruff et al.
4,306,330 A * 12/1981 Jinkins ..... 15/325
5,249,333 A * 10/1993 Worwag ..... 15/387
5,293,665 A * 3/1994 Worwag ..... 15/328

FOREIGN PATENT DOCUMENTS

DE 196 02 406 1/1997
FR 2387015 * 12/1978 ..... 15/387

* cited by examiner

*Primary Examiner*—Chris K. Moore
(74) *Attorney, Agent, or Firm*—Gudrun E. Huckett

(57) ABSTRACT

A vacuum cleaning tool has a housing with a brush chamber and a turbine chamber. A vacuum connector is connected to the housing remote from the brush chamber. A brush roller is arranged in the brush chamber and an air turbine is arranged in the turbine chamber for driving the brush roller. A vacuum airflow enters the brush chamber via a suction slot, flows from the brush chamber into the turbine chamber, flows within the turbine chamber through the air turbine, and exits from the turbine chamber into the vacuum connector. The turbine chamber has an intake cross-section transverse to a flow direction of the vacuum airflow that is greater than an outlet cross-section at the turbine chamber end facing the outlet window. Intermediate cross-sections of the interior of the turbine chamber decrease in a direction toward the turbine chamber end such that the turbine chamber tapers toward the outlet cross-section.

25 Claims, 4 Drawing Sheets

Fig. 4
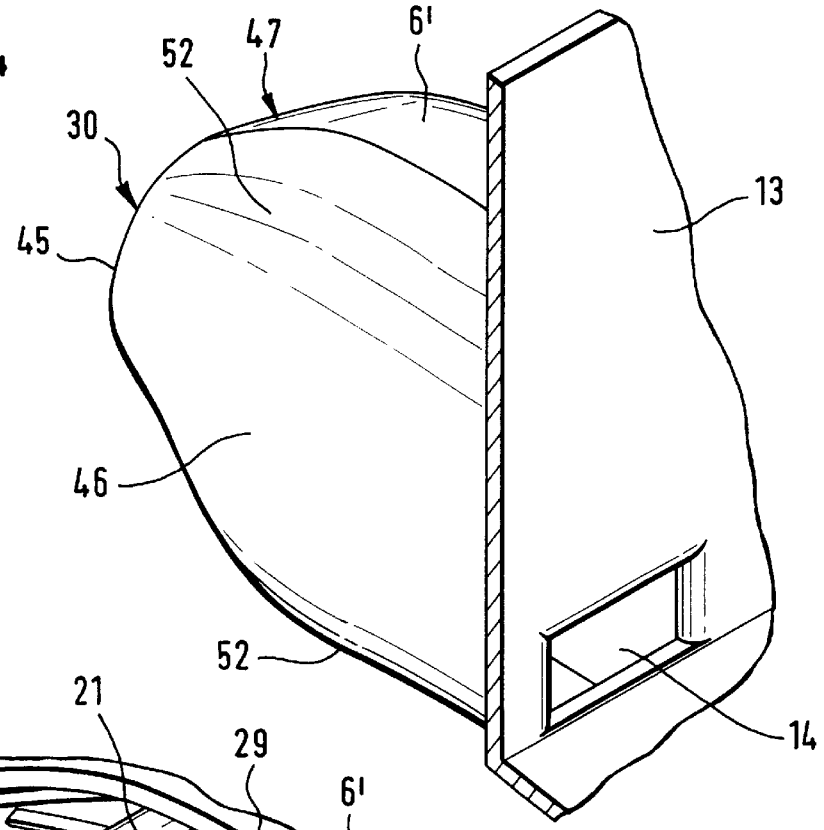
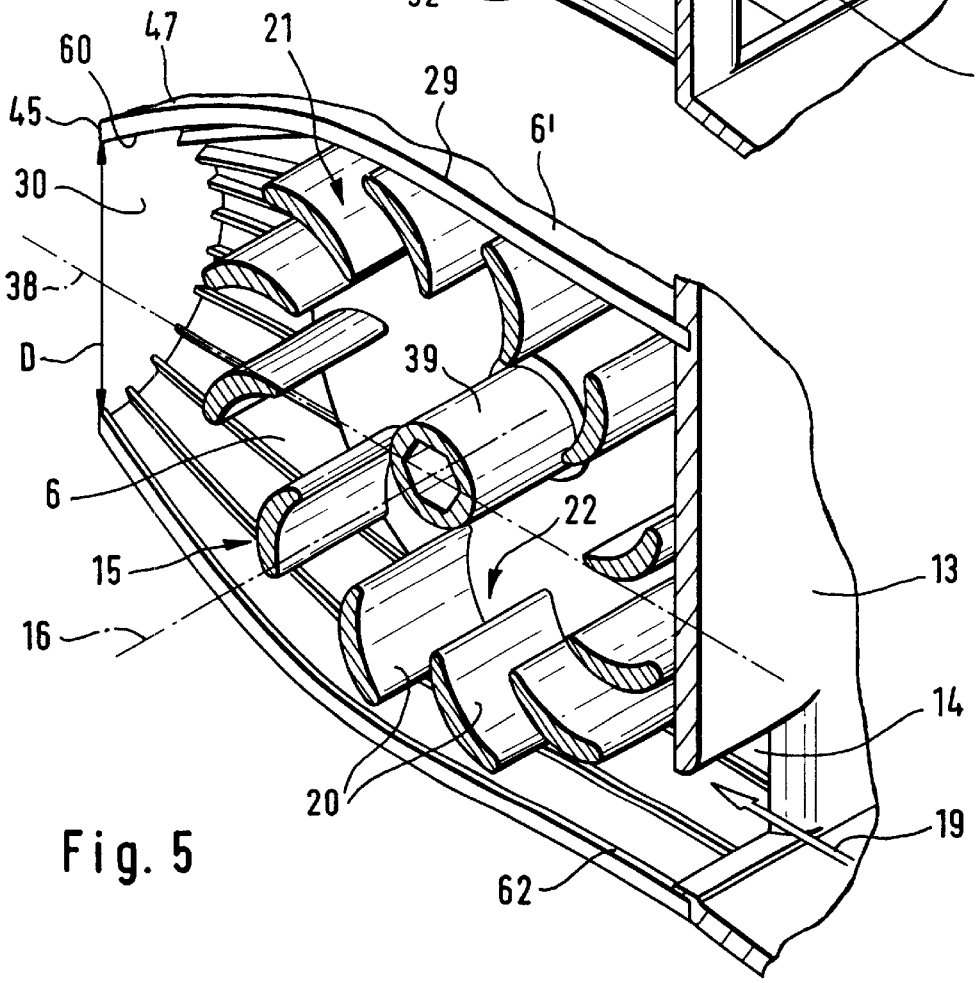
Fig. 5

VACUUM CLEANING TOOL WITH PEAR-SHAPED TURBINE CHAMBER

BACKGROUND OF THE INVENTION

1. Field of the Invention

The invention relates to a vacuum cleaning tool for a vacuum cleaning device comprising a housing in which a brush chamber and a turbine chamber are provided. A working roller, in particular, a brush roller, is arranged in the brush chamber transversely to the working direction of the suction cleaning tool. The working roller penetrates with a peripheral portion a suction slot provided in the bottom of the brush chamber. An air turbine is arranged in the turbine chamber for driving in rotation the working roller. A vacuum airflow of the vacuum cleaning tool enters the brush chamber via the suction slot, flows into the turbine chamber via an intake window provided in a partition between the brush chamber and the turbine chamber, and exits from the turbine chamber through an outlet window of a vacuum connector. Between neighboring vanes of an annular vane arrangement of the air turbine free flow paths to a vane-free center of the air turbine are formed; the vacuum airflow passes through the vane-free center of the air turbine along its path from the intake window to the outlet window of the vacuum connector.

2. Description of the Related Art

Such a vacuum cleaning tool is known from U.S. Pat. No. 5,249,333. It is comprised substantially of a housing with a brush chamber and a turbine chamber. In the brush chamber a brush roller is arranged transversely to the working direction of the vacuum cleaning tool. Its bristles project through the suction slot in the bottom of the brush chamber in order to mechanically act onto the floor surface to be cleaned. The air turbine arranged in the turbine chamber drives by means of a belt drive the brush roller in rotation, wherein the vacuum airflow flowing through the vacuum cleaning tool drives the air turbine.

In order to achieve a higher power output, the air turbine is configured as a direct flow turbine in which between neighboring vanes of an annular vane arrangement free flow paths are formed which allow the vacuum airflow to enter the vane-free center of the air turbine. On its path from the intake window into the turbine chamber and to the outlet window at the vacuum connector the vacuum airflow flows thus twice through the annular vane arrangement so that a high power output can be achieved. As a result of this special flow arrangement of the air turbine, high rotational speeds up to 30,000 rpm are achieved which, however, results in an undesirable noise level increase.

SUMMARY OF THE INVENTION

It is an object of the present invention to further develop a vacuum cleaning tool of the aforementioned kind such that for a high power output of the air turbine a lowering of the noise level can be achieved.

In accordance with the present invention, this is achieved in that the intake cross-section of the turbine chamber measured at the partition in a direction transverse to the flow direction is greater than the outlet cross-section of the turbine chamber measured in the same direction at its end facing the outlet window and in that the cross-section of the turbine chamber decreases toward the outlet cross-section such that the turbine chamber tapers in the direction toward the outlet cross-section.

A high power output of the air turbine is achieved in that the turbine chamber is configured, while preventing dead space, such that its walls are positioned with minimal spacing relative to the air turbine. For this purpose, the intake cross-section of the turbine chamber at the level of the partition is configured to be larger than the outlet cross-section of the turbine chamber measured in the same direction and same position at the end facing the outlet window. In this connection, the intermediate cross-sections measured between the intake cross-section and the outlet cross-section in the direction toward the outlet cross-section become smaller so that the turbine chamber tapers in the direction toward the outlet cross-section. This achieves, on the one hand, a combination of the partial flows of the working airflow and of fault flows forming in the turbine chamber, wherein a directed guiding to the outlet window is realized. Accordingly, the airflow is made more uniform; the guiding of the vacuum airflow out of the turbine chamber is assisted in a beneficial way so that the vacuum airflow entering the turbine chamber enters substantially disruption-free the vane-free center of the air turbine.

The configuration of the turbine chamber is preferably symmetrical to the longitudinal center axis, i.e., the mathematical center of gravity of each cross-section between the intake cross-section and the outlet cross-section is approximately located on the longitudinal center axis of the turbine chamber. For achieving more beneficial flow conditions, the center of the outlet window is also approximately located on the longitudinal center axis of the turbine chamber.

In order to moreover minimize dead spaces in the corners of the turbine chamber, the inner longitudinal edges of the turbine chamber are provided with a rounded configuration.

As a result of the relative height position of the outlet cross-section of the turbine chamber, which is positioned higher than the intake window in the partition, the flow through the air turbine is improved. In this connection, the upper edge of the intake window is positioned preferably below the lower edge of the outlet cross-section.

The turbine chamber roof and the turbine chamber bottom are positioned in close proximity to the mantle surface of the air turbine for minimizing fault flows, wherein the distance of the mantle surface to the turbine chamber bottom and to the turbine chamber roof is minimal, respectively, and the two distances are preferably identical.

For an additional lowering of the operating noises it is suggested to provide on the inner wall surface of the turbine chamber wall, in particular, on the inner wall surface of the turbine chamber roof, at least one rib which extends approximately in the flow direction. In this connection, the rib extends from the intake cross-section, in particular, without interruptions, to the outlet cross-section and has preferably the same height along its length. This height substantially bridges the distance between the turbine chamber wall and the air turbine. In this connection, it was found to be advantageous to arrange ribs diametrically opposed to one another relative to the longitudinal center axis; the ribs are positioned in a common plane with the longitudinal center axis. When several ribs are arranged about the inner circumference of the turbine chamber and have preferably the same height, their planes are aligned with the longitudinal center axis of the turbine chamber. This means that all planes of all ribs intersect one another in the longitudinal center axis of the turbine chamber.

BRIEF DESCRIPTION OF THE DRAWING

In the drawing:

FIG. 4 shows a detail of the exterior of the turbine chamber;

FIG. 5 is a longitudinal section of the turbine chamber with inner ribs arranged on the turbine chamber wall;

DESCRIPTION OF THE PREFERRED EMBODIMENTS

Figure 1:
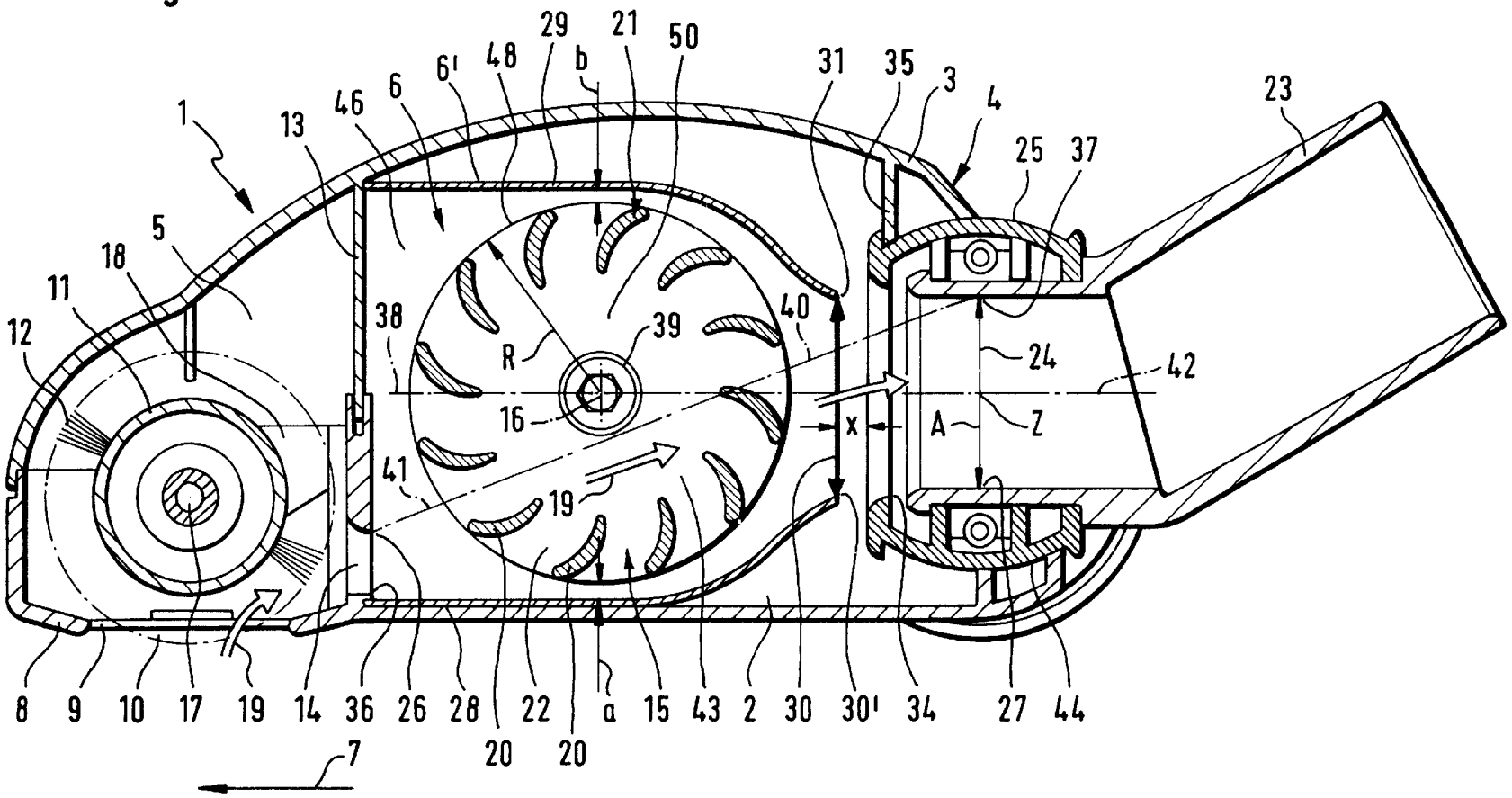
FIG. 1 is a plan view of a vacuum cleaning tool according to the invention.

The vacuum cleaning tool 1 illustrated in FIG. 1 has a housing 4 which is comprised of a shell-like bottom housing part 2 and a shell-like top housing part 3. A brush chamber 5 and a turbine chamber 6 are provided in the housing 4 wherein the turbine chamber 6 is formed by an inner turbine chamber housing 6' which is arranged as a separate housing within the housing 4 of the vacuum cleaning tool The brush chamber 5 is arranged in the working direction 7 upstream of the turbine chamber 6 and has arranged therein a working roller 11 transversely to the working direction 7. The working roller 11 penetrates with a circumferential portion a suction slot 9 provided in the bottom 8 of the housing 4. In the illustrated embodiment, the working roller 11 is a brush roller with bristles 12 which project with the peripheral portion 10 from the suction slots 9 for mechanical action on the floor surface to be cleaned.

The turbine chamber 6, i.e., the turbine chamber housing 6', is separated from the brush chamber 5 by a partition 13 provided in the housing 4 wherein an intake window 14 is provided in the partition 13 which is arranged close to the turbine chamber bottom 28. In the illustrated embodiment, the turbine chamber bottom 28 forms a boundary of the intake window 14, i.e., the lower edge 36 of the intake window 14 is positioned at the level of the turbine chamber bottom 28.

In the turbine chamber 6 of the turbine chamber housing 6', an air turbine 15 is arranged whose axis of rotation 16 extends transversely to the working direction 7. The axis of rotation 16 is supported in the sidewalls 46 of the turbine chamber housing 6'. By means of a belt drive 18 (not illustrated in detail) the working roller 11 is driven in rotation about its bearing axle 17 by the air turbine 15.

Figure 6:
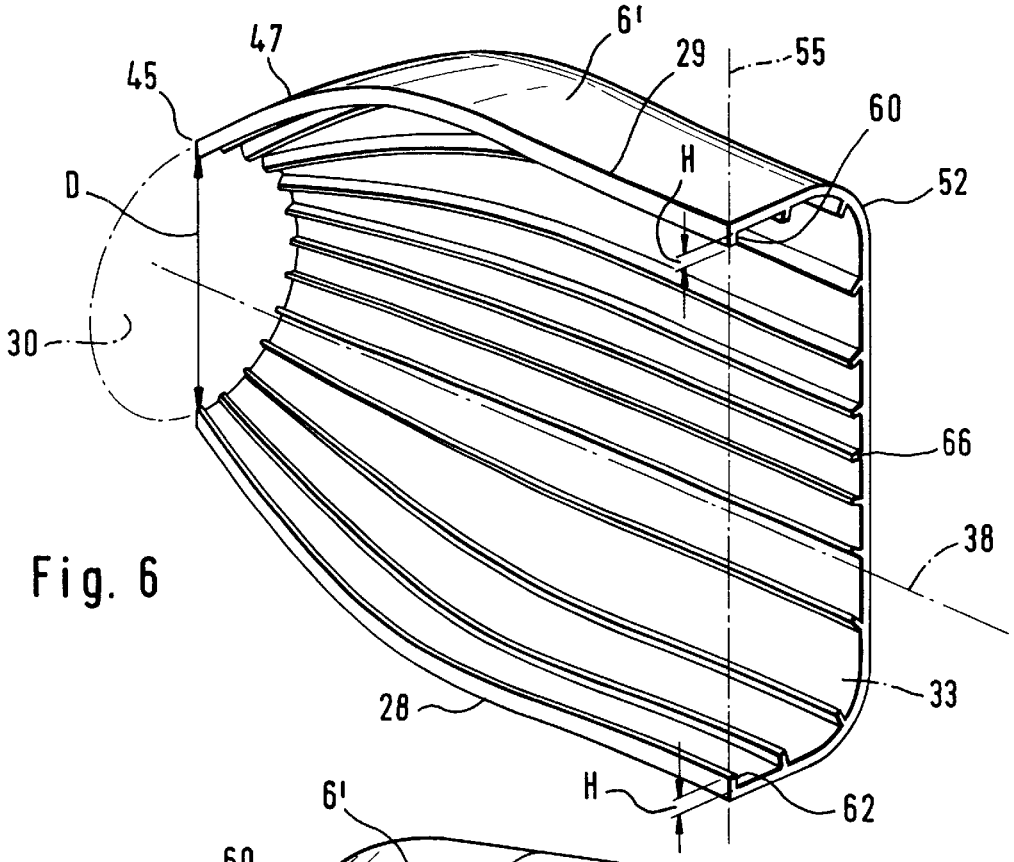
FIG. 6 is a section of the turbine chamber showing ribs on the inner wall surface.

The drive action of the air turbine 15 is realized by a vacuum airflow 19 which is generated by a vacuum cleaning device (not illustrated) which is connected to the vacuum connector 23. The vacuum airflow 19 enters the brush chamber 5 via the suction slot 9, flows via the intake window 14 into the turbine chamber 6, and exits the turbine chamber 6 via the open outlet cross-section 30 which is approximately positioned opposite the outlet window 24 of the vacuum connector 23. The outlet cross-section 30 of the turbine chamber 6, as illustrated in FIGS. 5 and 6, is substantially of a circular cross-section and has a diameter D matching the diameter A of the outlet window 24. Preferably, the circular outlet cross-section 30 is somewhat smaller than the cross-section of the outlet window 24 so that the edge 31 of the turbine chamber housing 6' covers the housing edge 34 of the outlet window 24 in the flow direction 19.

Figure 2:
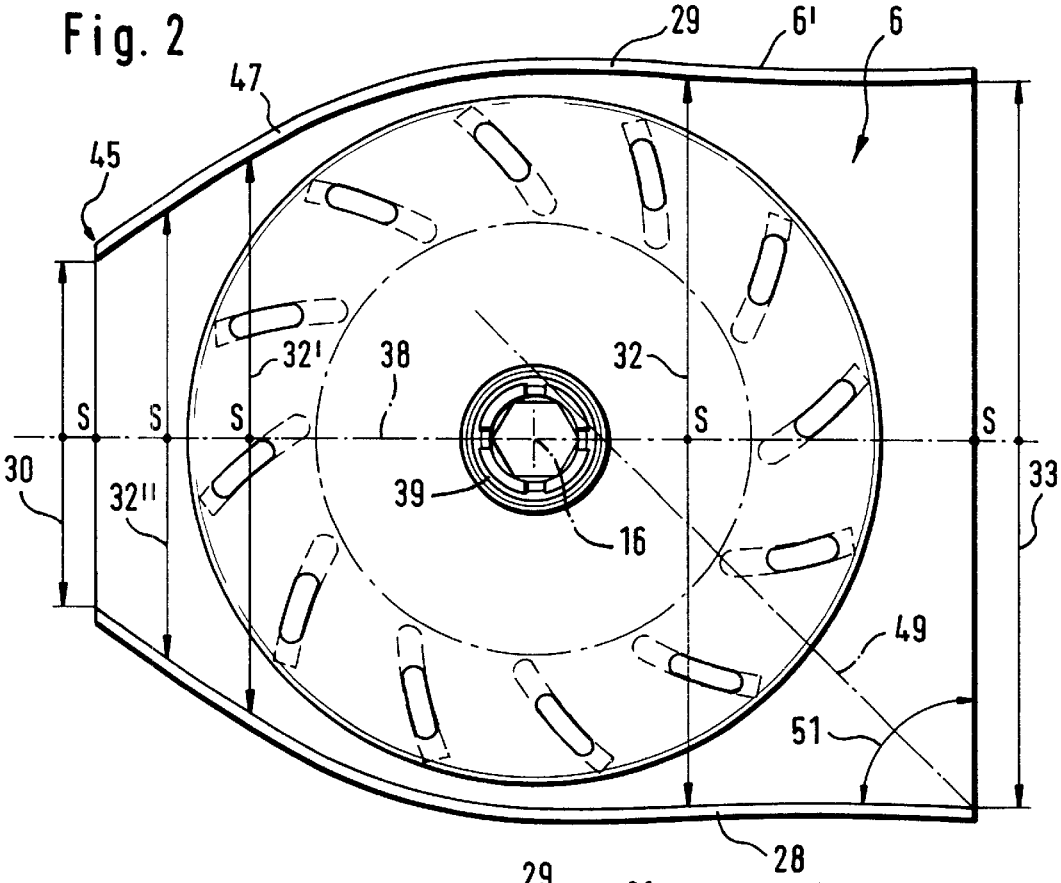
FIG. 2 is an enlarged longitudinal section of the turbine chamber with an air turbine arranged therein.

As illustrated in FIG. 2, the mantle surface 48 of the air turbine 15 is positioned at a minimal, preferably identical, distance a and b to the turbine chamber bottom 28 and the turbine chamber roof 29, respectively. This close arrangement of the turbine chamber bottom 28 and of the turbine chamber roof 29 relative to the air turbine 15 forces the vacuum airflow 19 into the center 50 of the air turbine 15. For this purpose, between neighboring vanes 20 of the annular vane arrangement 21 flow paths 22 are formed which open into the center 50. The incoming vacuum airflow 19 accordingly flows once through the annular vane arrangement 21 near the intake window 14 in the direction of the arrows indicated in FIG. 1 and then flows a second time through the vane arrangement 21 from the center 50 outwardly at the level of the outlet window 24. The flow that is generated in this way is additionally improved in that in the flow direction 19 the outlet window 24 is positioned higher than the intake window 14. Accordingly, the upper edge 26 of the intake window 14 is positioned below the lower edge 27 of the outlet window 24. An imaginary connecting line 40 between the upper edge 26 of the intake window 14 and the upper edge 37 of the outlet window 24 separates as a secant 41 a circle segment 43 from the cross-section of the air turbine. In this circle segment 41 four to six, in the illustrated embodiment, five vanes 20 are preferably positioned in any rotational position of the air turbine 15. In this connection, the annular vane arrangement 21 has about its circumference 10 to 14, preferably 12, vanes 20 positioned equidistantly in the circumferential direction. The vanes 20 are positioned relative to a radial line R at an angle of approximately 30° to 50°, preferably of approximately 40°. The connecting line 40 extends such that it forms approximately a tangent to the hub 39 of the air turbine 15.

The axis of rotation 16 of the airturbine 15 is positioned approximately on the longitudinal center axis 38 of the turbine chamber housing 6', wherein the longitudinal center axis 38 penetrates the outlet window 24 at the center Z.

The vacuum connector 23 has an end portion which forms the outlet window 24 and is rotatable by means of this end portion about an axis 42 which is oriented in the working direction 7 within a part-cylindrical swivel part 25. The part-cylindrical swivel part 25 is positioned in a swivel socket 44 so that the vacuum connector 23 is pivotable about the center Z of the outlet window 24. The center Z of the outlet window 24 is positioned thus on the swivel axis of the joint part 25.

In order to ensure a sufficient movability of the swivel part 25, the edge 31 of the turbine chamber housing 6' is positioned at a spacing x to the housing back wall 35. In this way, space for movement of the housing edge 34 of the vacuum connector 23 pivoting about the center is provided. Since the housing edge 34 is rounded in the direction toward the outlet window 24 and the outlet cross-section 30 is positioned at least congruently with the outlet window 24, a turbulent-free flow of the vacuum airflow 19 out of the turbine chamber 6 via this outlet window 24 is realized.

In order to achieve in the flow direction 19 a smooth flowing of the vacuum airflow 19 driving the air turbine 15, it is suggested to configure the intake cross-section 33 at the level of the partition 13 of a larger size than the outlet cross-section 30 of the turbine chamber 6 at its end 45 facing the outflow window 24. In this connection, the intake cross-section 33 is positioned preferably parallel to the outlet cross-section 30, wherein the intermediate cross-section 32 of the chamber 6, also measured parallel thereto, between the intake cross-section 33 and the outlet cross-section 30 decreases in the direction toward the outlet cross-section 30. Preferably, the intermediate cross-section 32 remains substantially unchanged from the intake cross-section 33 to approximately the level of the axis of rotation 16 of the air turbine and then decreases steadily. Between the axis of rotation 16 and the outlet cross-section 30, the intermediate cross-sections 32' and 32" therefore taper toward the outlet cross-section 30.

The turbine chamber 6 or the turbine chamber housing 6' is thus configured with axial symmetry relative to the longitudinal center axis 38 of the turbine chamber 6. This means that the mathematical center S (mathematical center of gravity) of each cross-section 30, 32, 32', 32", 33 is positioned approximately on the longitudinal center axis 38 of the turbine chamber 6 which center axis 38 extends in the flow direction of the vacuum airflow 19. In this connection, the position of the outlet window 24 is selected such that its center Z is also at the level of the longitudinal center axis 38.

The turbine chamber 6 or the turbine chamber housing 6' has thus in a side view an approximately "pear-shaped" or "bottleneck-shaped" configuration wherein the end portion 47 of the turbine chamber 6 facing the outlet window 24 tapers uniformly, in particular, in the form of a bottleneck configuration. In this connection, the outlet cross-section 30 is positioned symmetrical to the longitudinal center axis 38 of the turbine chamber 6.

Figure 7:
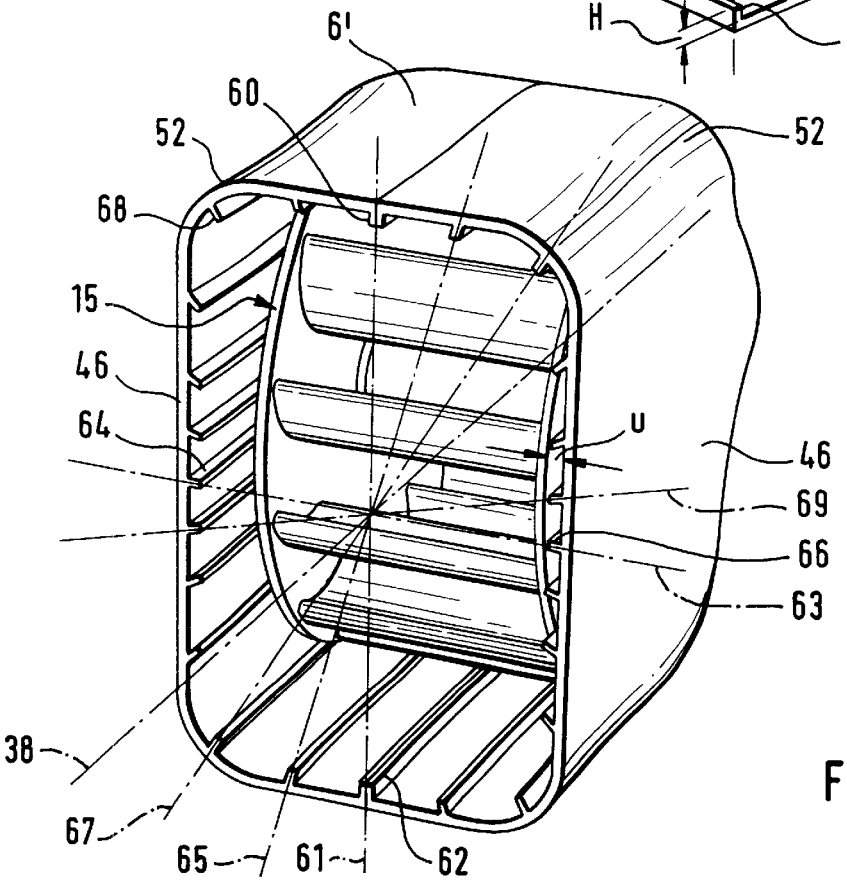
FIG. 7 is a perspective view of the turbine chamber with ribs viewed from the intake side.

As illustrated in FIGS. 6 and 7, the intake cross-section 33 is a rectangle with rounded corners. The outlet cross-section 30 has substantially the shape of a circle, as illustrated in FIG. 6.

Within the turbine chamber 60 the position of the turbine 15 is selected such that with its axis of rotation 16 it is positioned below the bisecting line 49 which bisects an angle 51 defined between the turbine chamber bottom 28 and the intake cross-section 33 positioned at a right angle thereto at the level of the intake window 14. Preferably, the bisecting line 49 approximately contacts (is a tangent to) the hub 39 of the air turbine 15.

The longitudinal edges 52 of the turbine chamber 6 are rounded in order to form as little dead space as possible in the turbine chamber 6. The rounded longitudinal edges 52 extending in the direction of the longitudinal center axis 38 have a transition into the circular shape of the outlet cross-section 30, as can be seen in FIG. 4. The sidewalls 46 of the turbine chamber wall are positioned (compare FIGS. 3 and 7) at a minimal distance u to the axial end faces 53 of the air turbine 15. In the illustrated embodiment, the air turbine 15 is comprised substantially of two cover disks forming the axial end faces 53 with vanes 20 positioned therebetween. It may also be advantageous to configure the cover disks as rings, as is indicated in FIG. 2. The cover disk of the air turbine 15 is then formed by the sidewall 46 of the turbine chamber 6 positioned at a minimal spacing to the axial end face 53.

As a further optimization of the output, in particular, for a noise level reduction, at least one rib 60 is provided on the inner wall surface of the turbine chamber wall, in particular, on the inner wall surface of the turbine chamber roof 29. The rib 60 extends approximately in the flow direction of the vacuum airflow 19 and extends expediently approximately parallel to the longitudinal center axis 38 of the turbine chamber 6, preferably without interruptions, from the intake cross-section 33 of the turbine chamber 6 up to its outlet cross-section 30. The ribs 60 project, as illustrated in particular in FIG. 7, into close proximity of the mantle surface 48 of the air turbine 15 wherein along their length they are formed substantially of the same height H. The rib 60 preferably determines a plane 61 in which the longitudinal center axis 38 of the turbine chamber 6 is also positioned.

In a preferred embodiment about the inner circumference of the intermediate cross-sections of the chamber, several ribs 60, 62, 64, and 66 are arranged. They extend in the direction of the longitudinal center axis 38. In this connection, relative to the longitudinal center axis 38, two ribs 64, 66 and 60, 62, respectively, are positioned diametrically opposite one another. The diametrically oppositely arranged ribs 60, 62 and 64, 66 are positioned in a common plane 61 and 63, respectively. The common planes 61, 63 intersect one another on the longitudinal center axis 38. The longitudinal center axis 38 is thus positioned, respectively, in a plane which is determined by diametrically oppositely arranged ribs.

As a result of this configuration all ribs are aligned relative to the longitudinal center axis 38 of the turbine chamber 6. Accordingly, all planes 61, 63, 65, 67, 69 of oppositely arranged ribs intersect one another on the longitudinal center axis 38. In this connection, the rib arrangement is such that a rib 68 also extends along the longitudinal edges 52 of the turbine chamber 6, respectively.

Figure 3:
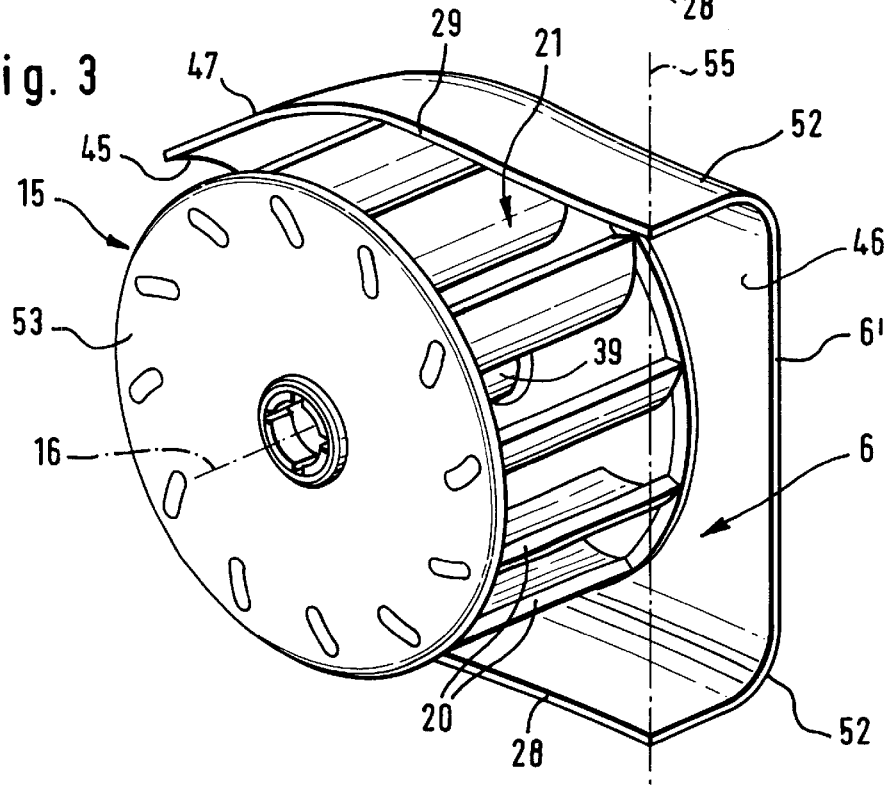
FIG. 3 is a perspective illustration of the air turbine with the turbine chamber partially cut away.

The turbine chamber 6 is advantageously comprised of two housing halves. A housing half without ribs is illustrated in FIG. 3, a housing half with ribs is illustrated in FIG. 6. The longitudinal center axis 38 of the turbine chamber housing 6' is positioned in the partition plane 55 between the two housing parts.

As can be taken from FIGS. 4 and 5, the intake window 14 is of a rectangular shape and extends substantially over the entire width of the turbine chamber 6 measured in the direction of the axis of rotation 16. The height of the intake window 14 is less than its width.

The ribs 66 arranged on the sidewalls 46 extend up to the axial end face 53 of the air turbine 15 so that also in this area a fault flow from the intake cross-section to the outlet cross-section of the turbine chamber flows out in a directed way as a result of the presence of the ribs so that a significant noise level reduction can be achieved. The height of the ribs 66 corresponds approximately to the distance u of the sidewall 46 from the end face of the air turbine 15.

While specific embodiments of the invention have been shown and described in detail to illustrate the inventive principles, it will be understood that the invention may be embodied otherwise without departing from such principles.

What is claimed is:

1. A vacuum cleaning tool for a vacuum cleaning device, the vacuum cleaning tool comprising:

a housing (4) having a partition (13) dividing an interior of the housing (4) into a brush chamber (5) and a turbine chamber (6), wherein the brush chamber (5) has a bottom (8) and vacuum slot (9) arranged in the bottom (8), and wherein the partition (13) has an intake window (14);

a vacuum connector (23) connected to the housing (4) remote from the brush chamber (5), wherein the vacuum connector (23) has an outlet window (24);

a working roller (11) arranged in the brush chamber (5) perpendicularly to a working direction (7) of the vacuum cleaning tool and having a peripheral portion (10) projecting from the brush chamber (5) through the vacuum slot (9) to the exterior of the housing (4);

an air turbine (15) arranged in the turbine chamber (6) and configured to drive in rotation the working roller (5);

wherein the air turbine (15) has vanes (20) arranged in an annular vane arrangement (21) with a vane-free center (50), wherein between the vanes (20) free flow paths (22) are provided extending toward the vane-free center (50);

wherein a vacuum air flow (19) enters the brush chamber (5) via the suction slot (9), flows from the brush chamber (5) through the intake window (14) into the turbine chamber (6), flows within the turbine chamber (6) from the intake window (14) to the outlet window (24) through the vane-free center (50), and exits from the turbine chamber (6) through the outlet window (24);

wherein the turbine chamber (6) has an intake cross-section (33) measured at the partition (13) in a direction transverse to a flow direction of the vacuum airflow (19) and a outlet cross-section (30) measured at an end (47) of the turbine chamber (6) facing the outlet window (24), wherein the intake cross-section (33) is greater than the outlet cross-section (30); and wherein intermediate cross-sections (32, 32', 32") of the interior of the turbine chamber (6) decrease in a direction toward the end of the turbine chamber (6) facing the outlet window (24) such that the turbine chamber (6) tapers toward the outlet cross-section (30).

2. The vacuum cleaning tool according to claim 1, wherein the working roller is a brush roller (11).

3. The vacuum cleaning tool according to claim 1, wherein the turbine chamber (6) has a longitudinal center axis (38) extending in the flow direction, wherein each of the intermediate cross-sections (32, 32', 32") has a center (S), and wherein the centers (S) of the intermediate cross-sections (32, 32', 32") are substantially aligned on the longitudinal center axis (38) of the turbine chamber (6).

4. The vacuum cleaning tool according to claim 3, wherein the outlet window (24) has a center (Z) and wherein the center (Z) is located on the longitudinal center axis (38) of the turbine chamber (6).

5. The vacuum cleaning tool according to claim 3, wherein the airturbine (15) has an axis of rotation (16), and wherein the intermediate cross-sections (32) in the area between the intake cross-section (33) and substantially the axis of rotation (16) of the air turbine (15) are substantially identical.

6. The vacuum cleaning tool according to claim 3, wherein the turbine chamber (6) has inner longitudinal edges (52) extending from the intake cross-section (33) to the outlet cross-section (30), wherein the inner longitudinal edges (52) are rounded.

7. The vacuum cleaning tool according to claim 3, wherein the end portion (47) of the turbine chamber (6) facing the outlet window (24) tapers uniformly.

8. The vacuum cleaning tool according to claim 7, wherein the end portion (47) of the turbine chamber (6) facing the outlet window (24) is bottleneck-shaped.

9. The vacuum cleaning tool according to claim 3, wherein the outlet cross-section (30) is positioned symmetrically to the longitudinal center axis (38) of the turbine chamber (6).

10. The vacuum cleaning tool according to claim 1, wherein the outlet cross-section (30) is positioned higher than the intake window (14).

11. The vacuum cleaning tool according to claim 10, wherein the intake window (14) has an upper edge (26) and wherein the outlet cross-section (30) has a lower edge (30'), wherein the upper edge (26) of the intake window (14) is positioned approximately below the lower edge (30') of the outlet cross-section (30).

12. The vacuum cleaning tool according to claim 11, wherein the turbine chamber (6) has a chamber bottom (28) and wherein the intake window (14) has a lower edge (36) positioned substantially at the chamber bottom (28).

13. The vacuum cleaning tool according to claim 1, wherein the turbine chamber (6) has a chamber bottom (28) and a chamber roof (29), wherein the air turbine (15) has a mantle surface (48) spaced at a minimal distance (a) from the chamber bottom (28) and the chamber roof (48).

14. The vacuum cleaning tool according to claim 13, wherein the mantle surface (48) has the same minimal distance (b) from the chamber bottom (28) and from the chamber roof (48).

15. The vacuum cleaning tool according to claim 1, wherein the turbine chamber (6) has axial sidewalls (46) and wherein the air turbine (15) has axial end faces (53) facing the axial sidewalls (46), and wherein the axial sidewalls (46) and the axial end faces (53) are spaced at a minimal distance (u) from one another.

16. The vacuum cleaning device according to claim 1, wherein the turbine chamber has a chamber wall having an inner wall surface and one or more ribs (60) provided on the inner wall surface and extending in the flow direction.

17. The vacuum cleaning tool according to claim 16, wherein the chamber wall comprises a roof (29) and wherein the one or more ribs (60) are located on the roof (29).

18. The vacuum cleaning device according to claim 16, wherein the one or more ribs (60) extends from the intake cross-section (33) to the outlet cross-section (30).

19. The vacuum cleaning tool according to claim 18, wherein the one or more ribs (60) have a height (H) that stays the same from the intake cross-section (33) to the outlet cross-section (30).

20. The vacuum cleaning tool according to claim 16, wherein the turbine chamber (6) has a longitudinal center axis (38), and wherein the one or more ribs (60) and the longitudinal center axis (38) are positioned in a common plane (61).

21. The vacuum cleaning tool according to claim 16, wherein the turbine chamber (6) has a longitudinal center axis (38), wherein several of the ribs (60,62, 64, 66, 68) are distributed about an inner circumference of the chamber wall, and wherein the several ribs (60, 62, 64, 66, 68) are oriented toward the longitudinal center axis (38).

22. The vacuum cleaning tool according to claim 21, wherein the several ribs (60, 62, 64, 66, 68) have the same height.

23. The vacuum cleaning tool according to claim 1, wherein the turbine chamber (6) has a chamber bottom (28) and wherein the intake cross-section (33) and the chamber bottom (28) are positioned at an angle (51) to one another, wherein an axis of rotation (16) of the air turbine (15) is positioned in an area of a bisecting line (49) of the angle (51) between the intake cross-section (33) and the chamber bottom (28).

24. The vacuum cleaning tool according to claim 23, wherein the axis of rotation (16) is positioned below the bisecting line (49).

25. The vacuum cleaning tool according to claim 23, wherein the air turbine (15) has a hub (39) and wherein the bisecting line (49) substantially contacts the hub (39).

* * * * *